US008405952B2

(12) United States Patent
Nawaz

(10) Patent No.: US 8,405,952 B2
(45) **Date of Patent: *Mar. 26, 2013**

(54) STUN GUN WITH FINGER GRIP

(75) Inventor: Babar Nawaz, Orlando, FL (US)

(73) Assignee: Jaguar Imports, LLC, Orlando, FL (US)

( * ) Notice: Subject to any disclaimer, the term of this patent is extended or adjusted under 35 U.S.C. 154(b) by 263 days.

This patent is subject to a terminal disclaimer.

(21) Appl. No.: 12/781,249

(22) Filed: May 17, 2010

(65) Prior Publication Data

US 2010/0296222 A1 Nov. 25, 2010

Related U.S. Application Data

(60) Provisional application No. 61/179,403, filed on May 19, 2009.

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 5,379,179 A * 1/1995 Graves ..... 361/232

* cited by examiner

*Primary Examiner* — Stephen W Jackson
(74) *Attorney, Agent, or Firm* — McKinney Law, PLLC

(57) ABSTRACT

A stun gun with finger grip is disclosed. The stun gun is configured to fit and be held firmly within a palm of a user's hand and easily gripped with the user's fingers. A trigger is disposed within a finger grip aperture of a front housing and rear housing of the stun gun, where the trigger causes the stun gun to discharge an electric shock through electrodes mounted above the finger grip aperture to stun an assailant. The finger grip aperture is configured and placed on the stun gun to receive the user's finger therein when the stun gun is being gripped by the user's hand. The finger grip aperture protects the user's finger and prevents the assailant from easily dislodging the stun gun from the user's hand. The user's finger may be placed completely through the finger grip aperture to provide a firm grip on the stun gun. In addition, in a struggle with the assailant, the user's finger can remain firmly on the trigger and continue to depress the trigger to repeatedly shock the assailant.

20 Claims, 4 Drawing Sheets

STUN GUN WITH FINGER GRIP

I. CROSS-REFERENCE TO RELATED APPLICATIONS

This application claims the benefit of U.S. Provisional Application No. 61/179,403 filed May 19, 2009. The disclosure of the provisional application is incorporated herein by reference.

II. FIELD

The present invention relates generally to personal protection devices, and more specifically to a stun gun with a finger grip that is carried by a person to provide an electrical and paralyzing shock to an assailant.

III. DESCRIPTION OF RELATED ART

Stun guns use a high voltage and a low current electrical discharge to immobilize an assailant. The electrical discharge causes the assailant's muscles to uncontrollably spasm so that the assailant is temporarily paralyzed. The voltage of a stun gun typically ranges between 20,000 to 650,000 volts. Batteries serve as a power supply to electrical circuitry consisting of various electrical components. The circuitry includes a transformer that boosts the voltage in the circuit and reduces the amperage of the electrical current. A capacitor is used to build up and store an electrical charge before discharging the electrical shock through a pair of electrodes to the assailant.

A shortcoming of the prior art stun guns is that they may be dislodged from a user's hand easily when attempting to use in self-defense. Accordingly, what is needed is a stun gun that is easy to grip and to hold securely in a person's hand.

Another shortcoming of the prior art is that the stun gun may be needed in dark and desolate areas such as a parking lot at night, for example, making it difficult to orientate and activate the stun gun. Accordingly, a need exists in the art for an improved stun gun that can be quickly and easily positioned correctly and activated to stop a potential assailant.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

IV. SUMMARY

In a particular embodiment, a stun gun with a finger grip is disclosed. The stun gun is configured to fit and be held firmly within a palm of a user's hand and easily gripped with the user's fingers. A trigger is disposed within a finger grip aperture of a front housing and rear housing of the stun gun, where the trigger causes the stun gun to discharge an electric shock through electrodes mounted above the finger grip aperture to stun an assailant. The finger grip aperture is configured and placed on the stun gun to receive the user's index finger (or other finger) therein when the stun gun is being gripped by the user's hand. The finger grip aperture protects the user's finger and prevents the assailant from easily dislodging the stun gun from the user's hand. The user's finger may be placed completely through the finger grip aperture to provide a firm grip on the stun gun including the front and rear housing. In addition, in a struggle with the assailant, the user's finger can remain firmly on the trigger and continue to depress the trigger to repeatedly shock the assailant.

It is therefore an object of the present invention to provide for an improvement that overcomes the aforementioned inadequacies of the prior art and provides a significant contribution to the advancement of stun gun devices.

These and other important objects, advantages, and features of the invention will become clear as this description proceeds. The invention accordingly comprises the features of construction, combination of elements, and arrangement of parts that will be exemplified in the description set forth hereinafter.

Both the foregoing general description and the following detailed description are explanatory and are not restrictive of the invention. The accompanying drawings, which are incorporated in and constitute part of the specification, illustrate embodiments of the present invention and together with the general description, serve to explain principles of the present invention.

V. BRIEF DESCRIPTION OF THE DRAWINGS

For a fuller understanding of the nature and objects of the invention, reference should be made to the following detailed description, taken in connection with the accompanying drawings, in which.

VI. DETAILED DESCRIPTION

Figure 1:
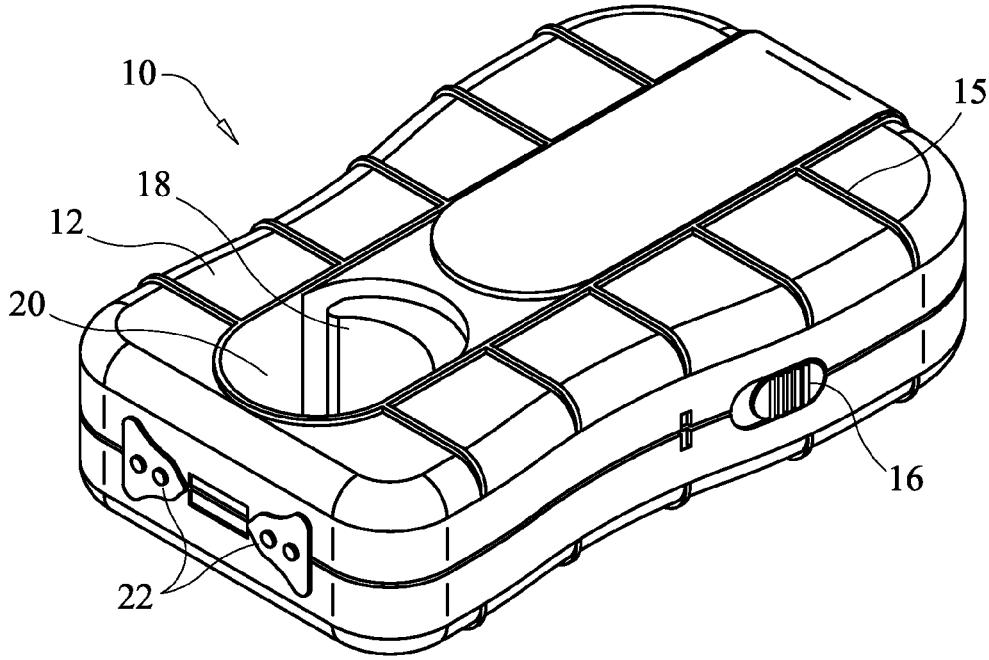
FIG. 1 is a top-front perspective view of a stun gun with finger grip in accordance with an embodiment of the present invention.

Referring now to FIG. 1, a stun gun 10 includes a front housing 12, which contains the electronic components and a rear housing 14 that mates to the front housing 12. The front housing 12 and rear housing 14 are substantially similar in shape and size, where the stun gun 10 is configured to fit and be held firmly within the palm of a user's hand and easily gripped with the user's fingers. The front housing and/or the rear housing may include ridges 15 that are adapted to help the user grip the stun gun without slipping.

The stun gun 10 includes an on/off switch 16 to arm the stun gun 10. The on/off switch 16 may be placed on either side of the stun gun 10. A trigger 18 is disposed within a finger grip aperture 20 of the front housing 12 and rear housing 14, where the trigger 18, upon being depressed, causes the stun gun 10 to discharge an electric shock through electrodes 22 to stun an assailant. The finger grip aperture 20 is configured and placed on the stun gun 10 to receive the user's index finger (or other finger) therein when the stun gun 10 is being gripped by the user's hand. The finger grip aperture 20 protects the user's finger and prevents the assailant from easily dislodging the stun gun 10 from the user's hand. The user's finger may be placed completely through the finger grip aperture 18 to provide a firm grip on the stun gun 10. In addition, in a struggle with the assailant, the user's finger can remain firmly on the trigger 18 and continue to depress the trigger 18 to repeatedly shock (or attempt to shock) the assailant. The finger grip aperture 20 also helps the user to orientate the stun gun 10 in low light conditions or in a panic situation.

In use, when the trigger 18 is depressed, a discharge circuitry for the stun gun 10 is activated using a circuit board so that the power supply energizes a transformer. A capacitor in turn is charged by the transformer until a predetermined discharge point causes the capacitor to discharge through the transformer that steps up the voltage and produces a high voltage across the electrodes 22.

Figure 2:
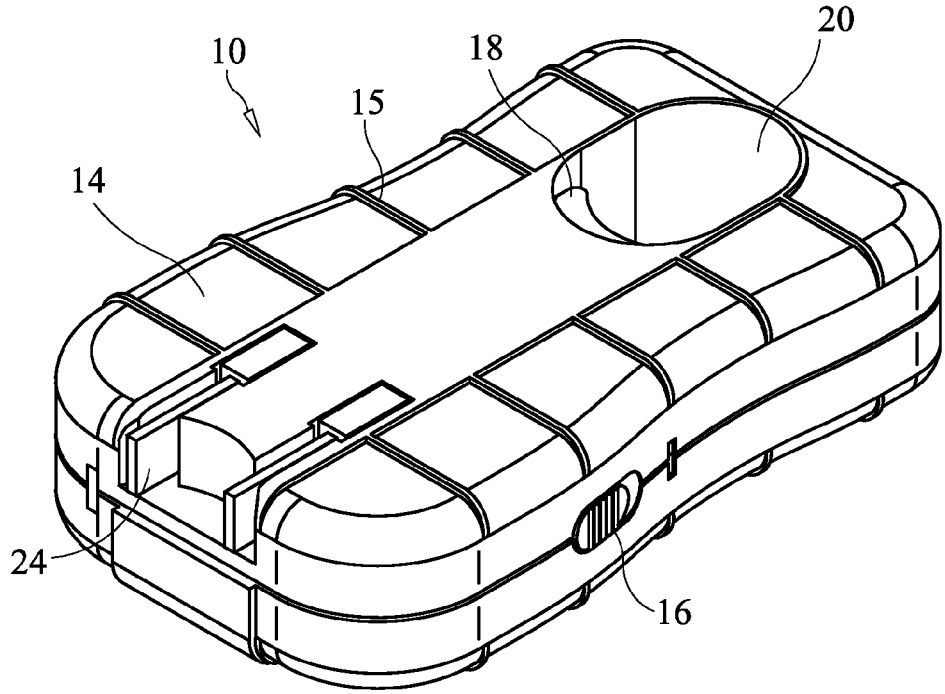
FIG. 2 is a bottom-rear perspective view of the stun gun with finger grip in accordance with an embodiment of the present invention.

A bottom-rear perspective view of the stun gun 10 is shown in FIG. 2 illustrating a rechargeable plug 24 that may be used to recharge the power supply of the stun gun 10. In use, household AC current is used to recharge the power supply of the stun gun 10. In a particular illustrative embodiment, the power supply comprises rechargeable batteries. In another particular illustrative embodiment, the power supply may be non-rechargeable batteries. The plug 24 is in electrical communication with the power supply for recharging with household AC current without having to remove the power supply from the stun gun 10.

Figure 3:
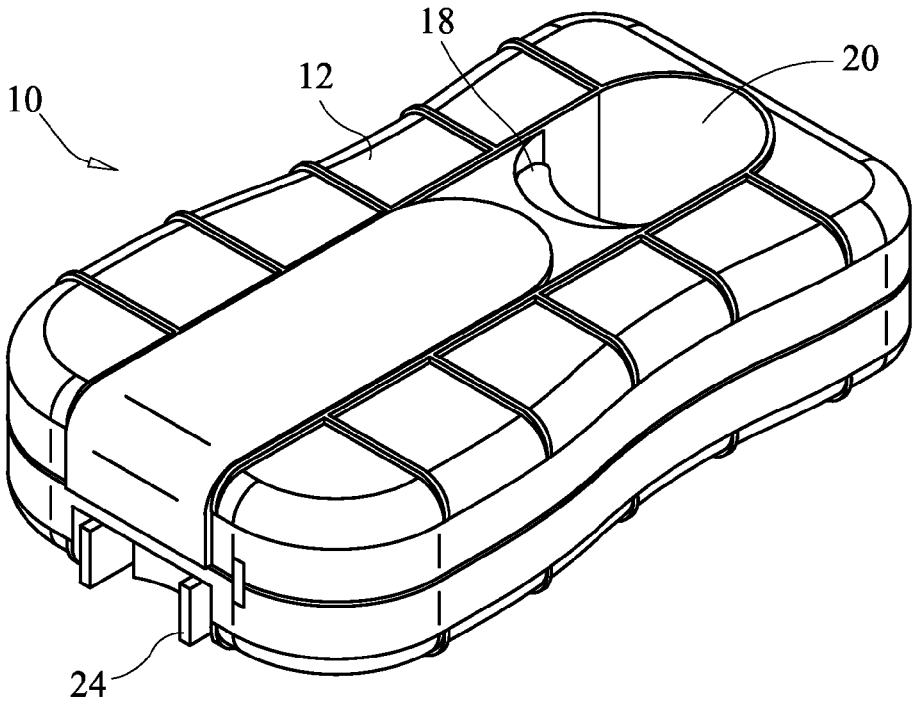
FIG. 3 is a bottom-front perspective view of the stun gun with finger grip in accordance with an embodiment of the present invention.
Figure 4:
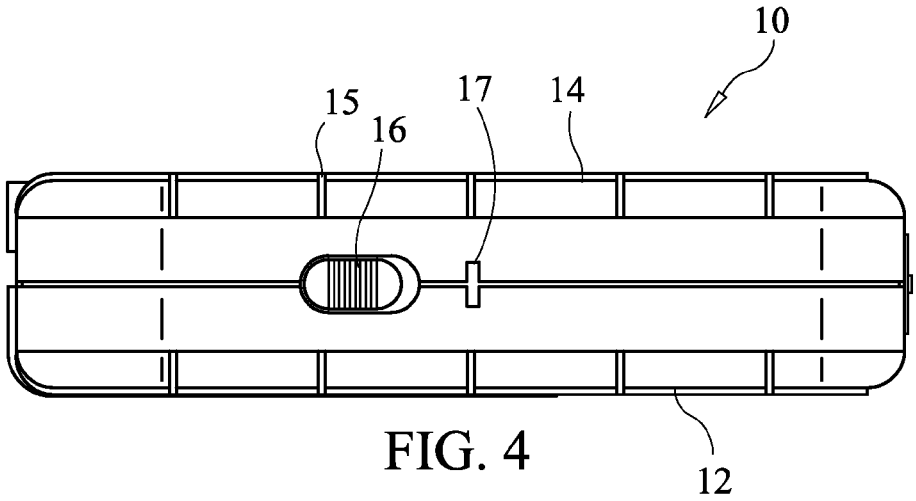
FIG. 4 is a left side view of the stun gun with finger grip in accordance with an embodiment of the present invention.
Figure 5:
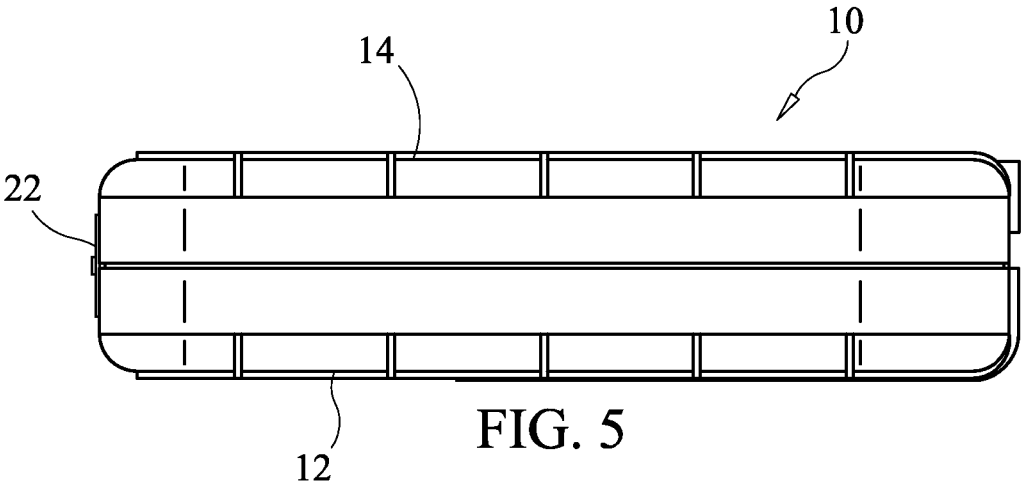
FIG. 5 is a right side view of the stun gun with finger grip in accordance with an embodiment of the present invention.

FIG. 3 is a bottom-front perspective view of the stun gun showing the finger grip aperture 20 that serves as the finger grip for the stun gun 10. The trigger 18 is located at the bottom portion of the finger grip aperture and when depressed, the trigger slides down into the housing 12, 14. FIG. 4 is a left side view of the stun gun 10 showing the on/off switch 16. The switch 16 may be located in the area on the stun gun 10 where the user's thumb is placed when gripping the stun gun 10. The stun gun 10 may be adapted for a left hand or right hand user depending on which side of the stun gun 10 that the on/off switch 16 is located or the switch 16 may be located on both sides of the stun gun 10. An indicator light 17 indicates to the user when the stun gun 10 is turned on and armed. FIG. 5 is a right side of the stun gun 10 shown in FIGS. 1-4 showing the front housing 12 and rear housing 14 of the stun gun 10.

Figure 6:
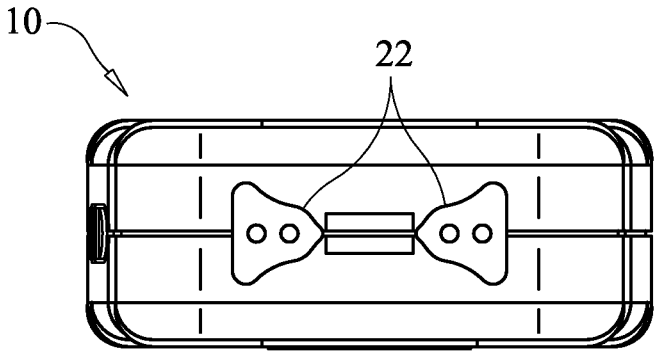
FIG. 6 is a top view of the stun gun with finger grip in accordance with an embodiment of the present invention.

FIG. 6 is a top view of the stun gun 10 showing electrodes 22 that are in electrical communication with a transformer within the stun gun 10. The electrodes 22 have a high voltage difference between them and are each comprised of a plate of conducting metal positioned in the circuit with a gap between them. Since the electrodes 22 have a high voltage difference between them, when the stun gun 10 is activated by the trigger 18, this gap is closed by touching an assailant's body, the electrical pulses will try to move from one electrode to the other, thereby providing an intense electrical shock to the assailant.

Figure 7:
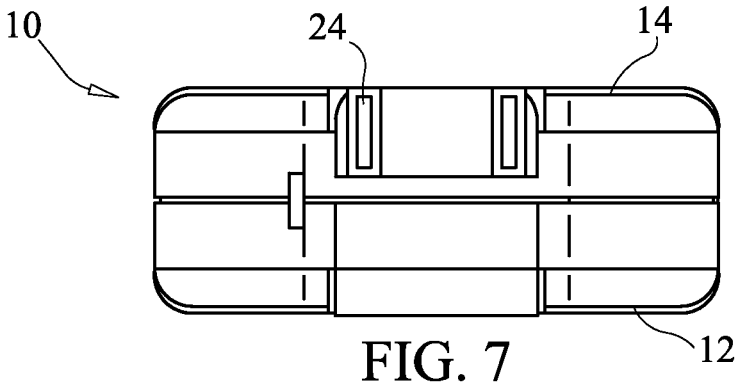
FIG. 7 is a bottom view of the stun gun with finger grip in accordance with an embodiment of the present invention.

The rechargeable plug 24 is shown in FIG. 7 mounted within the rear housing 14. The rechargeable plug 24 may be swung out and away from the rear housing 14 to be approximately perpendicular relative to the rear housing 14. This allows the rechargeable plug 24 to be inserted into a standard electrical outlet. When not in use, the rechargeable plug 24 is folded back into the rear housing 14 where it is unobtrusive.

Figure 8:
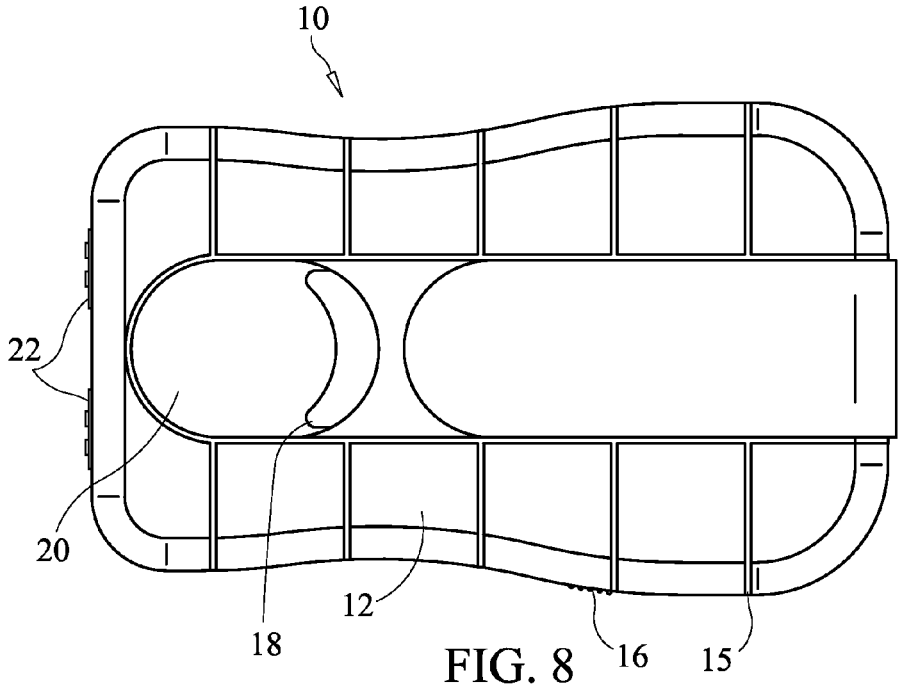
FIG. 8 is a front view of the stun gun with finger grip in accordance with an embodiment of the present invention.
Figure 9:
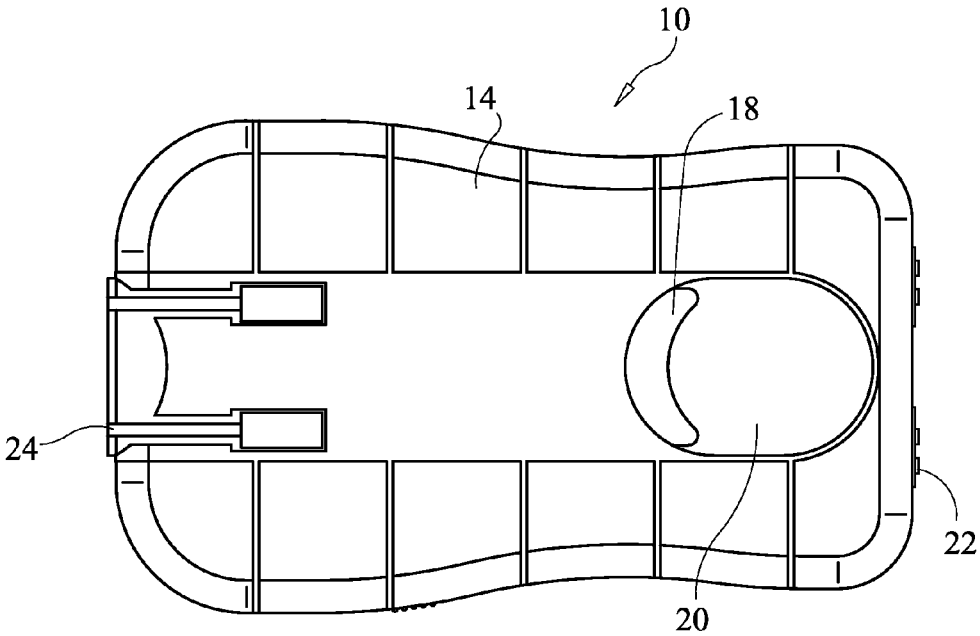
FIG. 9 is a rear view of the stun gun with finger grip in accordance with an embodiment of the present invention.

FIG. 8 is a front view of the stun gun 10 showing the configuration of the finger grip aperture 20, which serves as the finger grip for the stun gun 10. The longitudinal ridges 15 about the front housing 12 provide a non-slip surface for the user's hand. In addition, the location of the electrodes 22 directly above the user's finger when on the trigger 18, allows the user to easily apply the electrodes 22 to the assailant in an almost finger-pointing motion. FIG. 9 is a rear view of the stun gun 10 showing that the finger grip aperture 20 passes through the stun gun 10 and the location of the trigger 18. The rechargeable plug 24 is shown folded away into the rear housing 14.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

It is also to be understood that the following specification and drawings are intended to cover all of the generic and specific features of the invention herein described, and all statements of the scope of the invention, which as a matter of language, might be said to fall there between. The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

What is claimed is:

1. A stun gun, the stun gun comprising:

a housing adapted to be grasped and held firmly within a palm of a user's hand;

a finger grip aperture configured and placed on the stun gun to receive the user's finger therein when the stun gun is being gripped by the user's hand, wherein the finger grip aperture protects the user's finger and prevents an assailant from easily dislodging the stun gun from the user's hand; and a trigger disposed within the finger grip aperture and adapted to be activated by pushing down on the trigger with the user's finger, wherein the trigger causes the stun gun to discharge an electric shock through electrodes mounted directly above the finger grip aperture to stun an assailant.

2. The stun gun of claim 1, wherein the housing further comprising a front housing and a rear housing that mates to the front housing and are substantially similar in shape and size.

3. The stun gun of claim 2, wherein the housing further comprising ridges that are adapted to help the user grip the stun gun without slipping.

4. The stun gun of claim 3, further comprising an on/off switch to arm the stun gun, wherein the on/off switch is adapted to be placed on either or both sides of the stun gun.

5. The stun gun of claim 4, further comprising discharge circuitry that is activated when the trigger is depressed, wherein a power supply energizes a transformer and a capacitor in turn is charged by the transformer until a predetermined discharge point causes the capacitor to discharge through the transformer that steps up the voltage and produces a high voltage across the electrodes.

6. The stun gun of claim 5, further comprising a rechargeable plug to recharge the power supply of the stun gun, wherein household AC current is used to recharge the power supply.

7. The stun gun of claim 6, wherein the power supply comprises rechargeable batteries or non-rechargeable batteries.

8. The stun gun of claim 7, wherein the trigger is located at a bottom portion of the finger grip aperture and the trigger configured to slide down into the housing when depressed.

9. The stun gun of claim 8, further comprising an indicator light to indicate to the user when the stun gun is turned on and armed.

10. The stun gun of claim 9, wherein the electrodes have a high voltage difference between them and are each comprised of a plate of conducting metal positioned in the circuit with a gap between them, wherein when the stun gun is activated by the trigger, the gap is closed by touching an assailant's body as electrical pulses move from one electrode to the other to provide an intense electrical shock to the assailant.

11. The stun gun of claim 10, wherein the rechargeable plug is adapted to be swung out and away from the rear housing to be approximately perpendicular relative to the rear housing to allow the rechargeable plug to be inserted into a standard electrical outlet, the plug adapted to be folded back into the rear housing when not being used.

12. The stun gun of claim 11, wherein the location of the electrodes directly above the user's finger when on the trigger allows the user to easily apply the electrodes to the assailant in an almost finger-pointing motion.

13. A stun gun, the stun gun comprising:

a housing adapted to be grasped and held firmly within a palm of a user's hand;

a finger grip aperture configured to receive a user's finger therein; and a trigger located at a bottom portion of the finger grip aperture, wherein the trigger is configured to slide down into the housing and discharge an electric shock through electrodes when depressed.

14. The stun gun of claim 13, wherein the electrodes are mounted directly above the finger grip aperture to stun an assailant.

15. The stun gun of claim 14, wherein the trigger having a concave portion adapted to receive the user's finger.

16. The stun gun of claim 15, further comprising discharge circuitry that is activated when the trigger is depressed, wherein a power supply energizes a transformer and a capacitor in turn is charged by the transformer until a predetermined discharge point causes the capacitor to discharge through the transformer that steps up the voltage and produces a high voltage across the electrodes.

17. The stun gun of claim 16, further comprising a rechargeable plug to recharge the power supply of the stun gun, wherein household AC current is used to recharge the power supply.

18. The stun gun of claim 17, wherein the power supply comprises rechargeable batteries or non-rechargeable batteries.

19. A stun gun, the stun gun comprising:

a housing;

a finger grip aperture configured to receive a user's finger therein;

a trigger located at a bottom portion of the finger grip aperture; and electrodes mounted directly above the finger grip aperture to stun an assailant.

20. The stun gun of claim 19, wherein the trigger is configured to slide down into the housing and discharge an electric shock through the electrodes when depressed.

* * * * *